US012398730B1

(12) United States Patent
Alvarez Almendros et al.

(10) Patent No.: US 12,398,730 B1
(45) Date of Patent: Aug. 26, 2025

(54) PUMP WITH PRECAST CONCRETE DUAL VOLUTE

(71) Applicant: Flowserve Pte. Ltd., Singapore (SG)

(72) Inventors: Pablo Alvarez Almendros, Madrid (ES); Oscar Gato Salvador, Madrid (ES); Maxime Dominique Nicolas Leonard, Vienna (AT)

(73) Assignee: Flowserve Pte. Ltd., Singapore (SG)

( * ) Notice: Subject to any disclaimer, the term of this patent is extended or adjusted under 35 U.S.C. 154(b) by 0 days.

(21) Appl. No.: 18/678,179

(22) Filed: May 30, 2024

(51) Int. Cl.
*F04D 29/02* (2006.01)
*F04D 7/04* (2006.01)
*F04D 29/42* (2006.01)

(52) U.S. Cl.
CPC ..... *F04D 29/4293* (2013.01); *F04D 7/04* (2013.01); *F04D 29/026* (2013.01); *F04D 29/426* (2013.01)

(58) Field of Classification Search
CPC ..... F04D 29/406; F04D 29/426; F04D 29/428
See application file for complete search history.

(56) References Cited

U.S. PATENT DOCUMENTS 1,107,591 A * 8/1914 De Huff ..... F04D 29/4286 415/196
2,529,880 A * 11/1950 Mcclure ..... F25B 9/06 277/412
3,091,182 A * 5/1963 Anderson ..... F04D 29/445 415/196
3,186,685 A * 6/1965 Desbaillets ..... F01D 9/026 415/208.5
4,052,133 A * 10/1977 Yeater ..... F04D 9/005 415/214.1
5,304,034 A * 4/1994 Bouwman ..... F04D 13/02 415/214.1
6,508,625 B1 * 1/2003 Hoppenz ..... F04D 29/026 29/888.024

FOREIGN PATENT DOCUMENTS

CN 104196760 A * 12/2014

* cited by examiner

*Primary Examiner* — Justin D Seabe
(74) *Attorney, Agent, or Firm* — Maine Cernota & Curran

(57) ABSTRACT

A dual channel volute of a concrete volute pump (CVP) is prefabricated and then transported and assembled to its base at the application site. A cutwater recess is provided in the base into which the lower edge of the cutwater extends, thereby providing sufficient mechanical support of the cutwater to withstand all applied pressures and stresses during normal operation without distortion or failure. The base can further include a sidewall recess into which the lower edge of the sidewall extends. In embodiments, the disclosed volute is prefabricated in sections that are separately transported, and then assembled and sealed together at the application site. The cutwater and/or sidewall cuts that divide the sections can be within ten degrees of perpendicular to the cutwater and/or sidewall. An impeller chamber of the volute can be sufficiently large to contain an impeller having a diameter of at least 1.2 meters.

9 Claims, 11 Drawing Sheets

PUMP WITH PRECAST CONCRETE DUAL VOLUTE

FIELD OF THE INVENTION

The invention relates to concrete volute pumps (CVPs), and more particularly, to dual volute CVPs.

BACKGROUND OF THE INVENTION

When an application requires pumping of a very large volume of water or some other liquid, a concrete volute pump (CVP) can be the optimal solution, both technically, and from an economic point of view. Among other advantages, the concrete casing of the CVP volute guarantees strength and rigidity, while virtually eliminating corrosion and erosion, as well as ensuring consistently high pumping efficiency over sustained periods of operation. Simplicity of construction is also an advantage, as well as flexibility of design, in that a new volute design can be readily adapted and cast according to the specific requirements of each application. As a result, CVP pumps are widely used in seawater pumping applications, cooling water circulators and condensers for power plants, lift irrigation, water supply applications, drainage and flood control, dry docks, and desalination.

For relatively smaller CVP designs, the entire volute can be precast under controlled conditions, and then transported as a single element to the application site. For larger CVP designs, the volute can be precast in sections, and then the sections can be separately transported to the application site, assembled, aligned, and sealed to each other. As an alternative, the entire volute can simply be cast as one piece at the application site. Typically, for these larger CVPs, the impeller shaft is vertical, such that the pumped liquid flows from below into the pump and then horizontally through the volute.

Casting the entire volute at the application site has the advantage that it is unnecessary to transport the volute, as well as the advantage that the entire volute will be monolithic, which can provide optimal resistance to distortion and failure when subjected to high fluid pressures and flow rates. However, pre-casting the volute offers a significant advantage in terms of quality, dimensional accuracy, performance accuracy, project timeline and site installation time.

Typically, a CVP volute is installed onto an underlying base that supports other elements of the pumping system. Often, when the volute is to be precast, the weight and cost of the CVP are reduced by pre-casting the volute 100 without a bottom wall, so that the underlying base serves as the bottom wall when the volute is installed thereupon. Sealing of the relatively thick sidewall of the volute to the underlying base generally provides sufficient structural support to enable the volute to withstand any anticipated liquid pressures and flow rates.

An example of this approach is presented in FIGS. 1A-1C. It can be seen in the figures that the volute 100 comprises a sidewall 102 that extends downward from a top panel 104 and surrounds an impeller chamber 110, and that an upper edge of the sidewall 102 is monolithic with the top panel 104. In the illustrated embodiment, a bearing pedestal (not shown) containing a bearing within a bearing housing (not shown) is mounted to a "foundation ring" (not shown) which surrounds an opening 106 in the top panel 104. The pump motor, also not shown in the drawings, is supported on or above the bearing pedestal with the pump shaft extending downward through the bearing pedestal, so that it supports and rotates the impeller within the impeller chamber 110.

The pumped liquid enters the impeller chamber 110 from below, from which it is propelled through an opening 114 in the impeller chamber 108 into a volute passage 112 formed by the sidewall 102, through which the liquid, flows horizontally until it is discharged from the volute 100 through a volute outlet 108. FIGS. 1A and 1B illustrate the volute 100 as it is precast, while FIG. 1C illustrates placement of the volute 100 onto the base 116, and sealed thereto by an appropriate calking or grout 118.

Providing a "dual" volute is a classic technique for reducing the net radial forces that are generated by volute pumps. According to this approach, the volute is divided into two parallel passages that are separated by a relatively narrow "cutwater." The two passages draw fluid from opposing sides of the pump impeller, thereby balancing the radial forces applied to the impeller as it accelerates the fluid.

The dual volute approach can be applied to CVP pumps, typically by casting the volute at the application site. Precasting the volute of a dual volute CVP can be problematic, because the sealing attachment of the relatively narrow cutwater to the underlying base is frequently insufficient to withstand the forces that are applied to the cutwater during operation of the CVP, thereby leading to distortion and failure of the cutwater. And for large CVP pumps where the volute cannot be precast and transported as a whole, this problem is made worse by the relatively weaker joints that seal together the sections of the narrow cutwater.

Accordingly, if a dual volute of a CVP is cast at the application site, it can be difficult to achieve the required dimensional precision of the cutwater. And if the volute is prefabricated, the cutwater can lack mechanical support, and be subject to distortion and failure.

In addition, aligning and sealing at the application site of a CVP volute to the base, especially when it has been pre-fabricated in sections, requires that personnel be able to enter and work within the volute passages. This requirement places ergonomic constraints as to minimum sizes of the hydraulic passages, and thereby requires that the CVP volute must be of a certain size or larger. For a dual volute CVP, the widths of these passages are only half as large as corresponding single volute CVPs, which sets a lower limit of about 1.2 meters as the minimum diameter of the pump impeller for a dual volute CVP.

What is needed, therefore, is a dual volute CVP design wherein the volute can be prefabricated and then transported and assembled to its base at the application site, and for which sufficient mechanical support of the cutwater is provided to enable the cutwater to withstand all applied pressures and stresses during normal operation without distortion or failure, even if the volute was prefabricated in sections.

SUMMARY OF THE INVENTION

The present invention is a dual volute CVP, and a method of manufacture thereof, wherein the volute is prefabricated and then transported and assembled to its base at the application site, and sufficient mechanical support of the cutwater is provided to enable the cutwater to withstand all applied pressures and stresses during normal operation without distortion or failure. In embodiments, the disclosed volute is prefabricated in sections that are assembled and sealed together at the application site. In various embodiments, the CVP has a pump impeller diameter of at least 1.2 meters, According to embodiments of the present invention, the cutwater is precast together with a "top" panel thereof, and in embodiments the juncture therebetween is reinforced with rebar. If the volute is precast in sections, then each section of the cutwater is precast together with a corresponding section of the top panel. Accordingly, the upper edge of the cutwater is well supported structurally by the top panel of the volute.

Rather than merely sealing the bottom edge of the cutwater to the underlying base at the application site, a recess is provided in the base that corresponds to the shape of the lower edge of the assembled cutwater. Accordingly, when the volute is installed on the base, the lower edge of the cutwater extends into the recess, where it is sealed with grout. The bottom edge of the cutwater is thereby laterally supported and braced by the sidewalls of the recess that is provided in the base. The recess can be formed in the base by any means known in the art, such as by cutting using a laser or a focused stream of high-velocity sand, or by placing an appropriately shaped cover on top of the base while it is being cast.

A first general aspect of the present invention is a dual-channel CVP volute applicable to a concrete volute pump (CVP). The CVP volute includes a volute upper portion comprising a top panel, a sidewall, and a cutwater, the sidewall and cutwater being joined at upper edges thereof to the top panel, the sidewall and cutwater extending downward from the top panel and forming, in combination, an impeller chamber and two volute channels extending from opposing sides of the impeller chamber to a volute outlet, and a volute base comprising a cutwater recess into which a lower edge of the cutwater extends when the volute upper portion is placed onto the volute base and sealed thereto, the cutwater recess comprising cutwater recess sides that provide lateral support and bracing to the lower edge of the cutwater.

In embodiments, the upper edge of the cutwater is monolithic with the top panel.

In any of the above embodiments, a juncture between the upper edge of the cutwater and the top panel can be reinforced by rebar.

In any of the above embodiments, the lower edge of the cutwater can be sealed within the cutwater recess by grout.

In any of the above embodiments, the volute base can further comprise a sidewall recess into which a lower edge of the sidewall extends when the volute upper portion is placed onto the volute base and sealed thereto, the sidewall recess comprising sidewall recess sides that provide lateral support and bracing to the lower edge of the sidewall.

In any of the above embodiments, the volute upper portion can be precast as a plurality of volute sections that can be assembled and sealed to each other upon placement thereof onto the volute base, alignment and abutting together of corresponding section boundaries of the volute sections with each other, and sealing of the volute sections to each other and to the volute base. In some of these embodiments, at each location where one of the section boundaries intersects the cutwater, the section boundary is within ten degrees of being perpendicular to the cutwater. In any of these embodiments at each location where one of the section boundaries intersects the sidewall, the section boundary can be within ten degrees of being perpendicular to the sidewall.

In any of the above embodiments, the impeller chamber can be sufficiently large to contain an impeller having a diameter of 1.2 meters. In some of these embodiments, the impeller chamber is sufficiently large to contain an impeller having a diameter of 1.5 meters.

A second general aspect of the present invention is a method of providing a dual channel CVP volute at an application site. The method includes pre-casting a volute upper portion according to claim 1 at a location that is remote from the application site, locating a volute base according to claim 1 at the application site, transporting the precast volute upper portion to the application site, placing the volute upper portion onto the volute base at the application site, such that the lower edge of the cutwater of the volute upper portion extends into the cutwater recess provided in the volute base, and sealing the volute upper portion to the volute base, the cutwater recess sides of the cutwater recess thereby providing lateral support and bracing to the lower edge of the cutwater.

In embodiments, pre-casting the volute upper portion comprises pre-casting a plurality of volute upper portion sections, transporting the precast volute upper portion to the application site comprises separately transporting each of the volute upper portion sections to the application site, placing the volute upper portion onto the volute base at the application site comprises placing the volute upper portion sections onto the volute base and aligning and abutting together corresponding section boundaries of the volute upper portion sections with each other, and sealing the volute upper portion to the base comprises sealing the volute upper portion sections to the base and to each other. In some of these embodiments, at each location where one of the section boundaries intersects the cutwater, the section boundary is within ten degrees of being perpendicular to the cutwater. In any of these embodiments, at each location where one of the section boundaries intersects the sidewall, the section boundary can be within ten degrees of being perpendicular to the sidewall.

In any of the above embodiments, the volute base can further comprise a sidewall recess having sidewall recess sides, and wherein the lower edge of the sidewall extends into the sidewall recess when the volute upper portion is placed onto the volute base, such that such that the sidewall recess sides provide lateral support and bracing to the lower edge of the sidewall.

In any of the above embodiments, sealing the volute upper portion to the volute base can comprise applying grout to seal the lower edge of the cutwater within the cutwater recess.

In any of the above embodiments, the impeller chamber can be sufficiently large to contain an impeller having a diameter of 1.2 meters. In some of these embodiments, the impeller chamber is sufficiently large to contain an impeller having a diameter of 1.5 meters.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is a dual volute CVP, and a method of manufacture thereof, wherein, the volute is prefabricated and then transported and assembled to its base at the application site, and sufficient mechanical support of the cutwater is provided to enable the cutwater to withstand all applied pressures and stresses during normal operation without distortion or failure. In embodiments, the disclosed volute is prefabricated in sections that are assembled and sealed together at the application site. In various embodiments, the CVP has a pump impeller diameter of at least 1.2 meters, It will be noted that the term "volute" is sometimes used herein to refer to the volute upper portion, which is joined to the volute base at the application site to form the completed CVP volute.

Figure 1A:
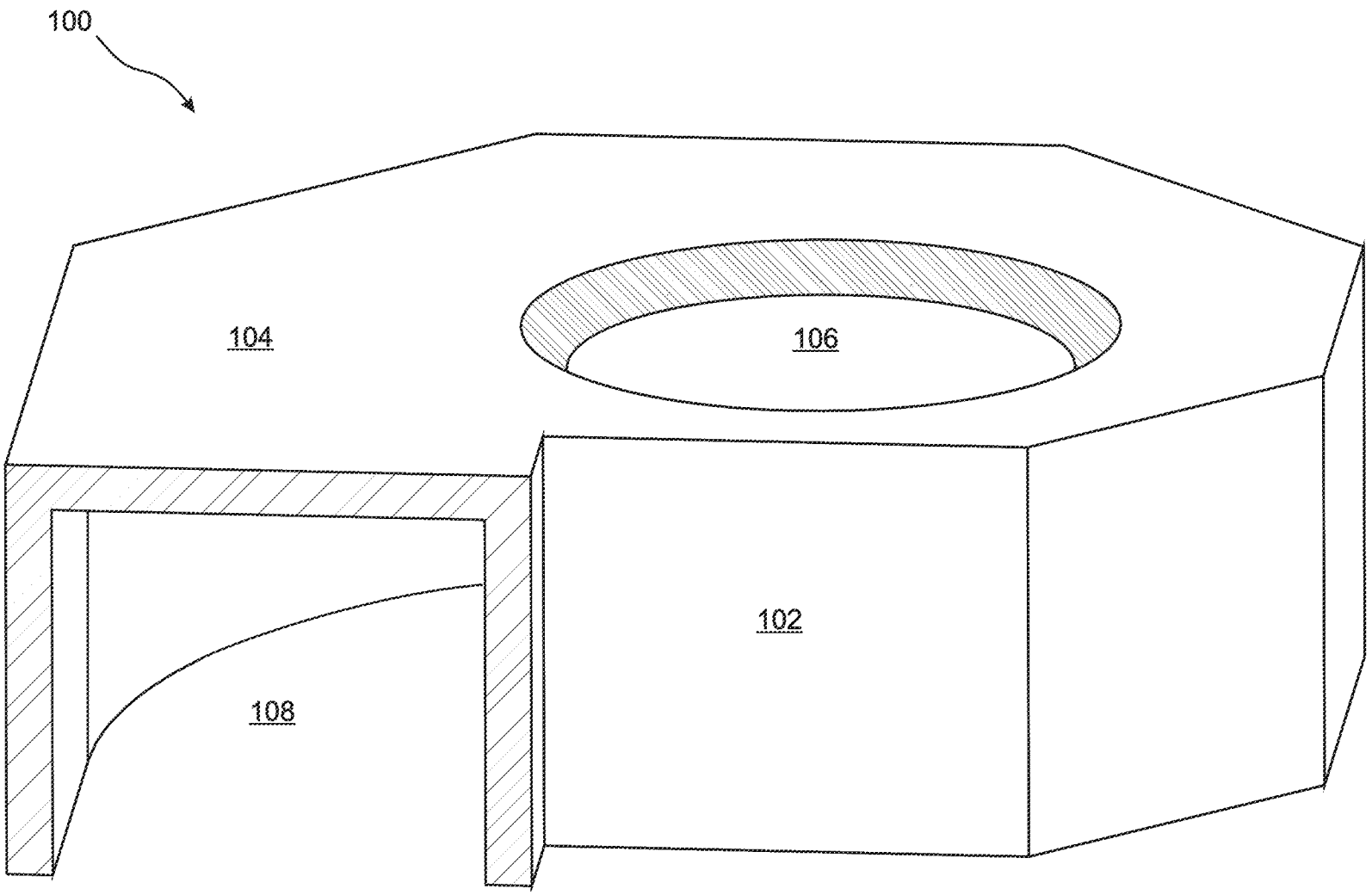
Fig. 1A Prior Art
FIG. 1A is a perspective front view from above of a single channel volute of the prior art.
Figure 1B:
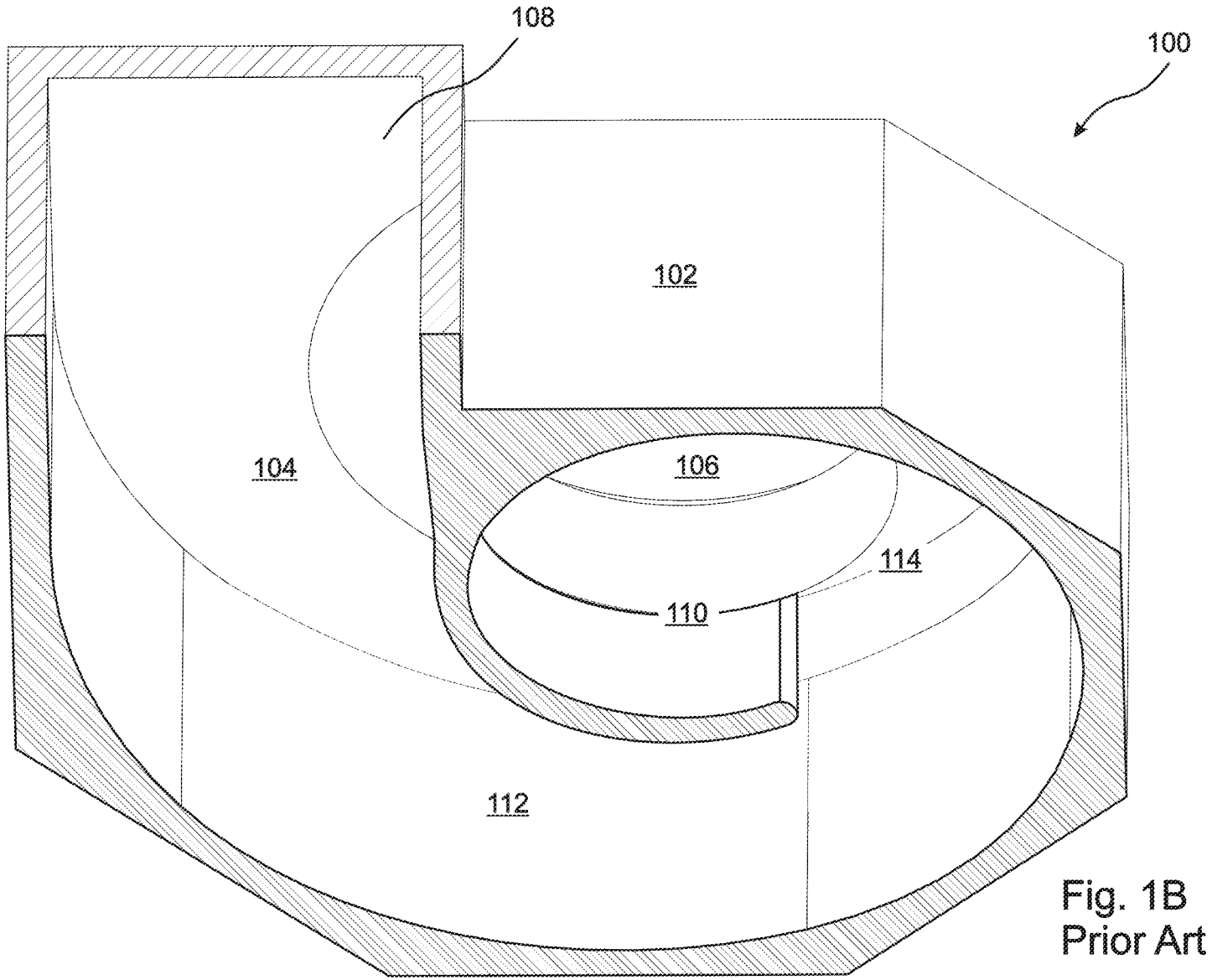
Fig. 1B Prior Art
FIG. 1B is a perspective front view from below of the volute of FIG. 1A
Figure 1C:
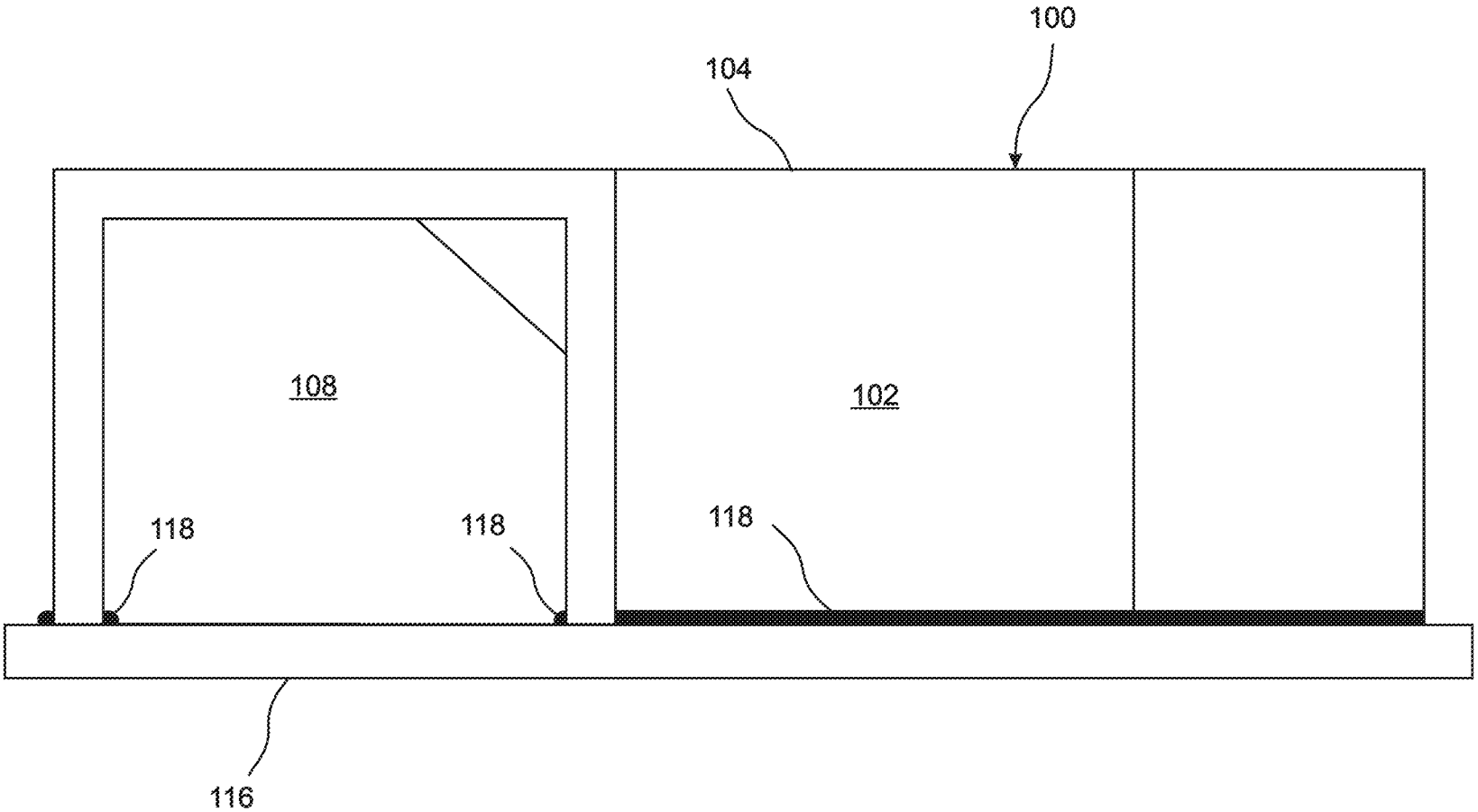
Fig. 1C Prior Art
FIG. 1C is a front view of the volute of FIG. 1A shown sealed to an underlying base.
Figure 2A:
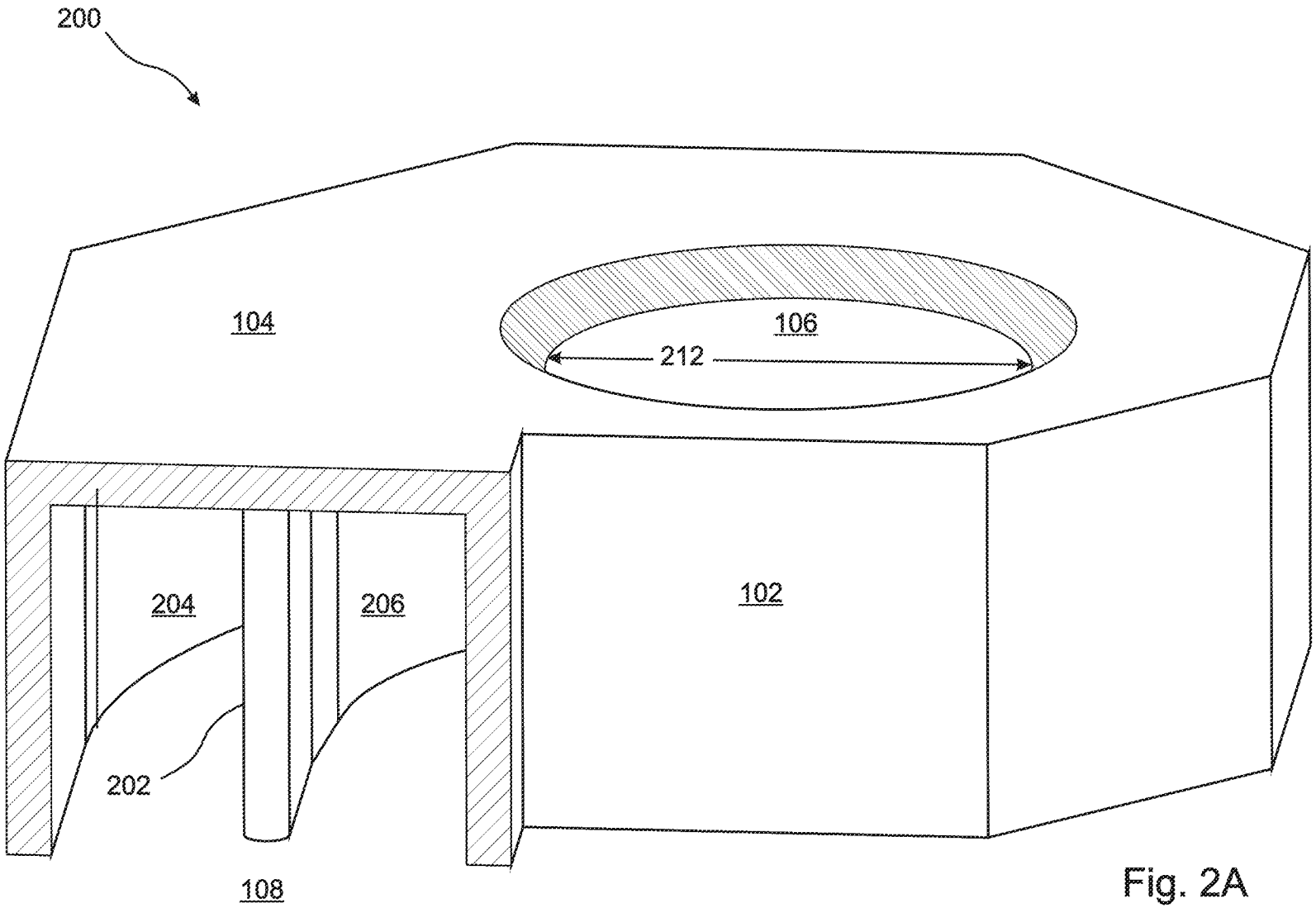
FIG. 2A is a perspective front view from above, drawn to scale, of a dual channel volute in a first embodiment of the present invention.
Figure 2B:
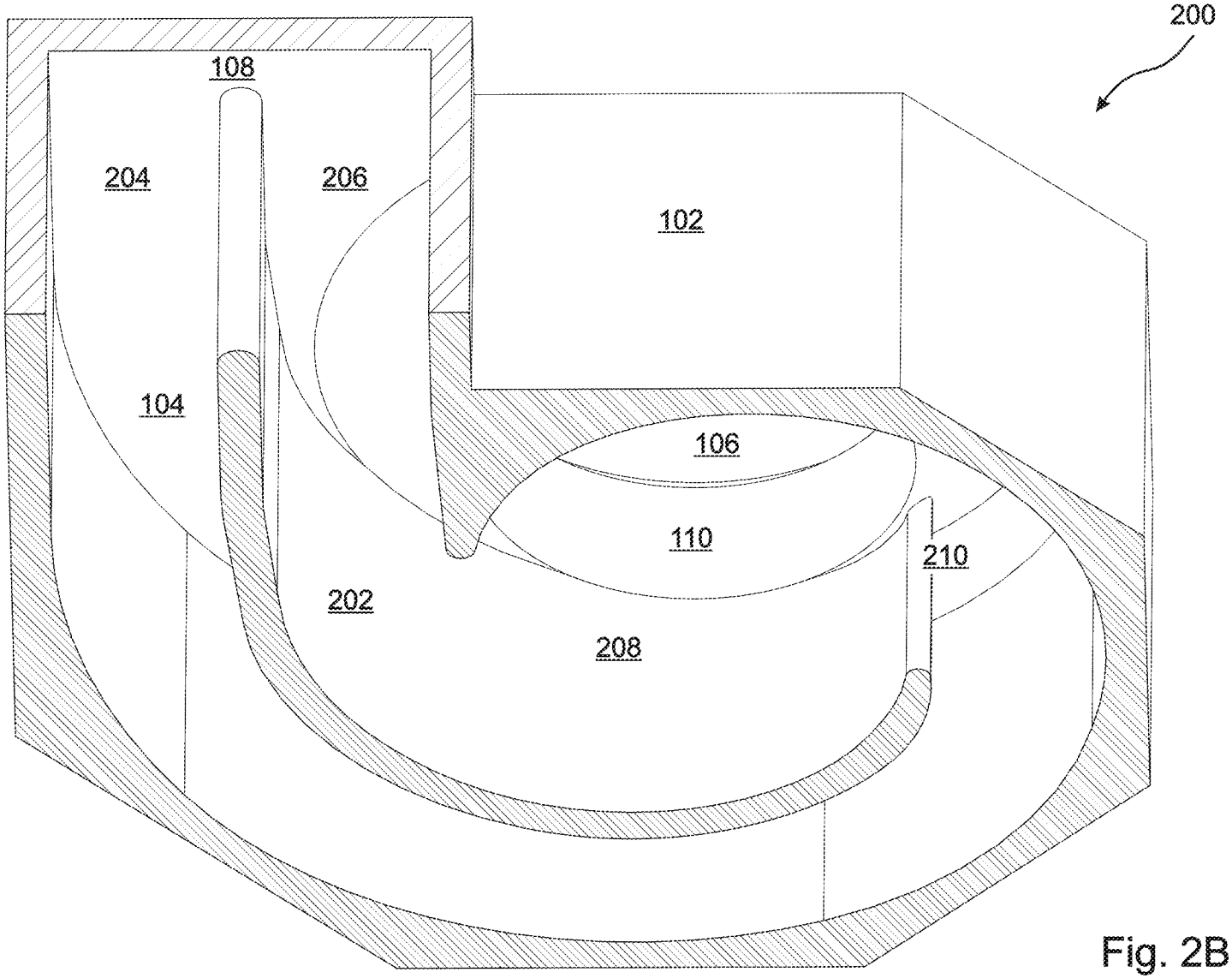
FIG. 2B is a perspective front view from below, drawn to scale, of the volute of FIG. 2A.

FIGS. 2A and 2B are perspective front views from above and below, respectively, of a first embodiment of the volute 200 of the present invention. The design is similar to FIGS. 1A and 1B, except that the volute passage 112 is divided into two passages 204, 206 by a cutwater 202. Liquid flows from the impeller into the two volute passages 204, 206 through two openings 208, 210 provided on opposing sides of the impeller chamber 110. In the illustrated embodiment, the diameter 212 of the opening 106 in the top panel 104, and the impeller chamber 110, are large enough to accommodate an impeller having a diameter of at least 1.2 meters, and in embodiments at least 1.5 meters.

Figure 3A:
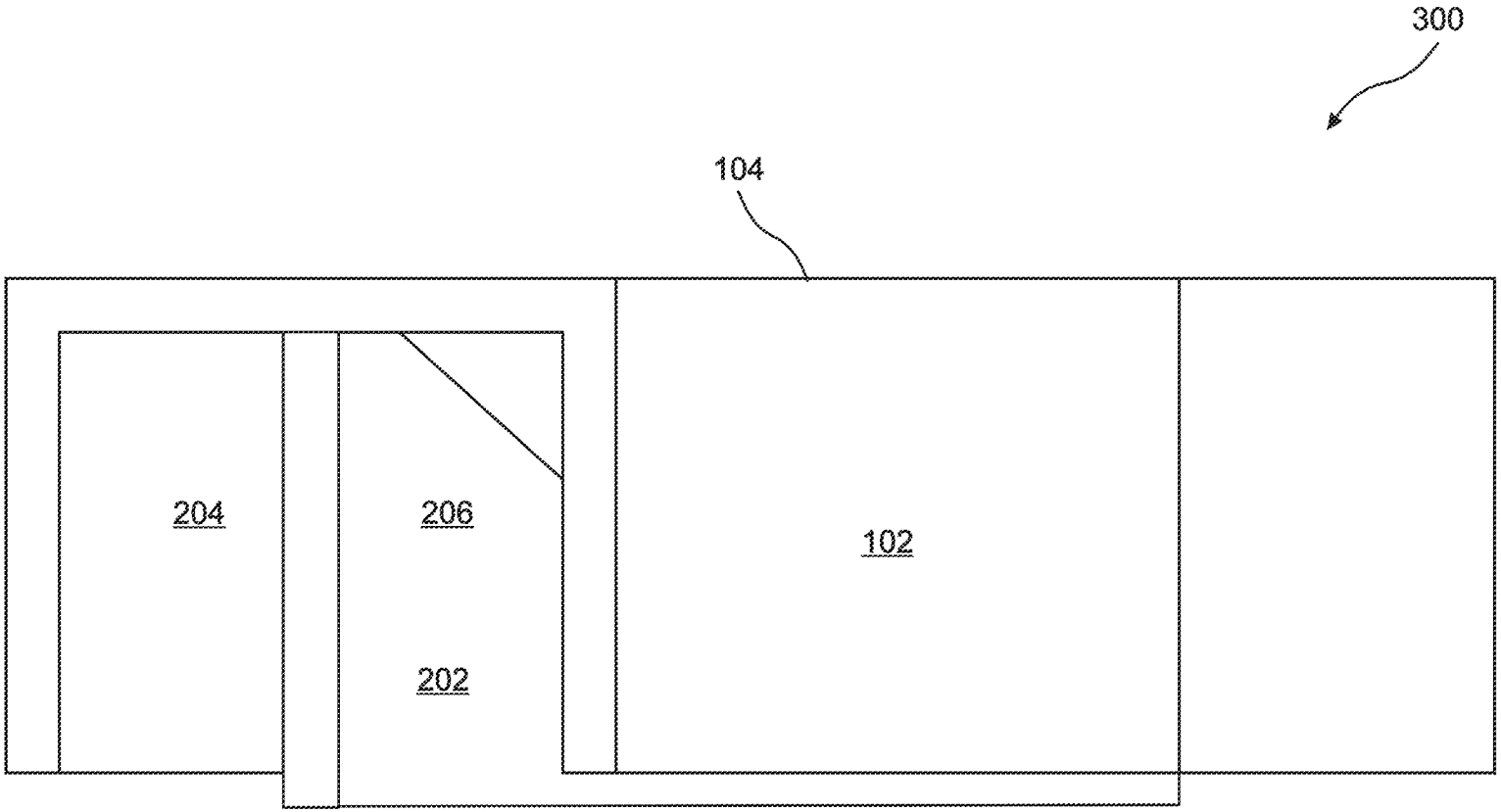
FIG. 3A is a front, drawn to scale, of a dual channel volute in a second embodiment of the present invention.
Figure 3B:
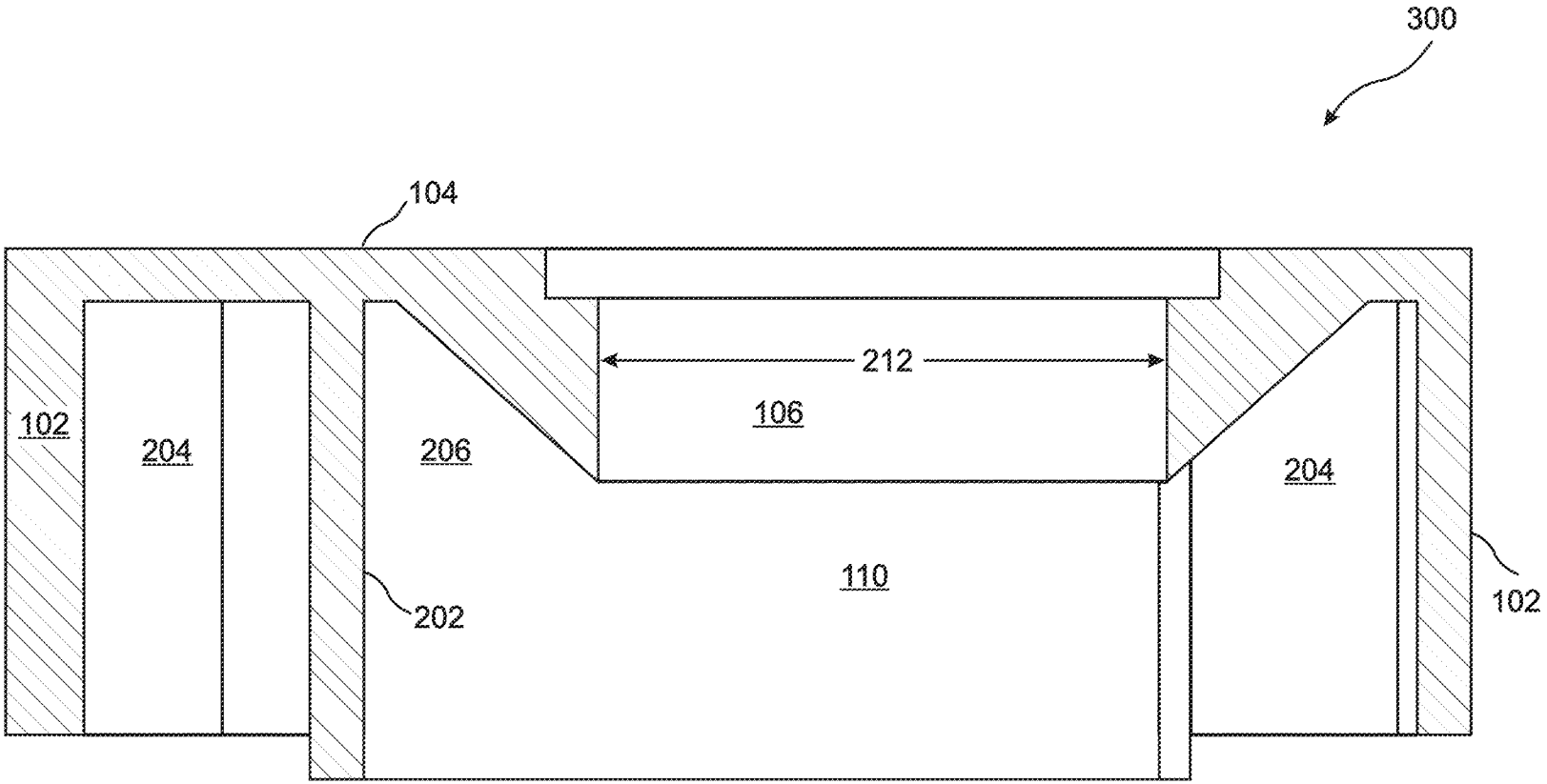
FIG. 3B is a sectional view, drawn to scale, of the volute of FIG. 3A.

FIGS. 3A and 3B are front and sectional views of a second embodiment of the volute 300 of the present invention, in which the cutwater 202 extends downward from the top panel 104 further than the sidewall 102. It can be seen in the drawings that the cutwater is precast together with the top panel 104, so that the upper edge of the cutwater 102 is monolithic with the top panel 104. In embodiments, the juncture therebetween is reinforced with rebar. In similar embodiments where the volute 300 is precast in sections, each section of the cutwater 202 is precast together with a corresponding section of the top panel 104. Accordingly, the upper edge of the cutwater 202 is well supported structurally by the top panel 103 of the volute 300.

Figure 3C:
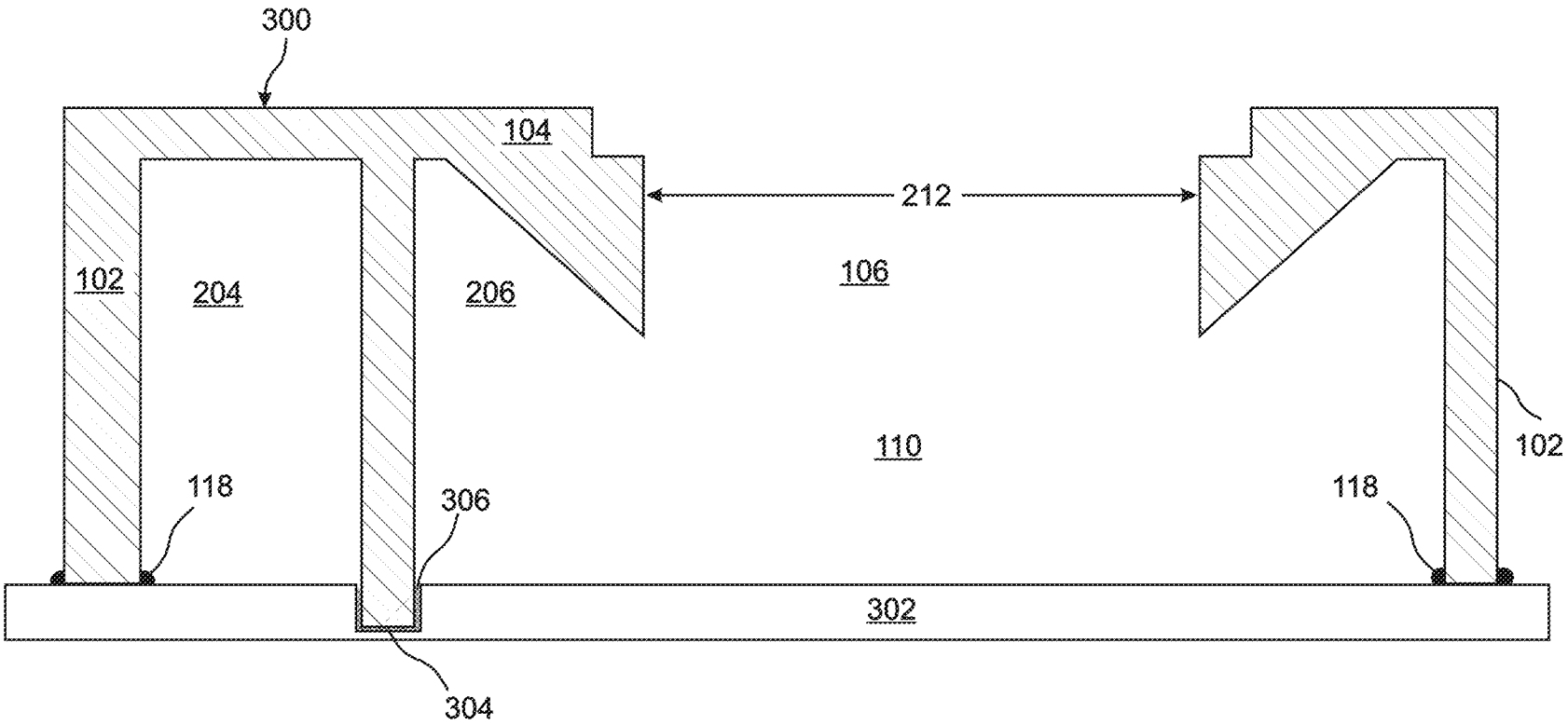
FIG. 3C is a cross-sectional view, drawn to scale, of the volute of FIG. 3A fixed to an underlying base.

FIG. 3C is a cross-sectional view that illustrates the joining of the volute 300 of FIGS. 3A and 3B with a base 302. In the illustrated embodiment, the sidewall 102 of the volute 300 rests on the base 302 and is sealed to the base 302 by caulking 118. The base 302 comprises a recess 304 that corresponds to the shape of the lower edge of the cutwater 202, such that the cutwater 202 extends into the recess 304 when the volute 300 is placed onto the base 302. Once the volute 300 is positioned and aligned, the recess 304 is filled with grout 306 so that the cutwater 202 is sealed to the base 302, and is also laterally supported and braced by the sidewalls of the recess 304. The recess 304 can be formed in the base 302 by any means known in the art, such as by cutting using a laser or a focused stream of high-velocity sand, or by placing an appropriately shaped cover on top of the base while it is being cast.

Figure 4:
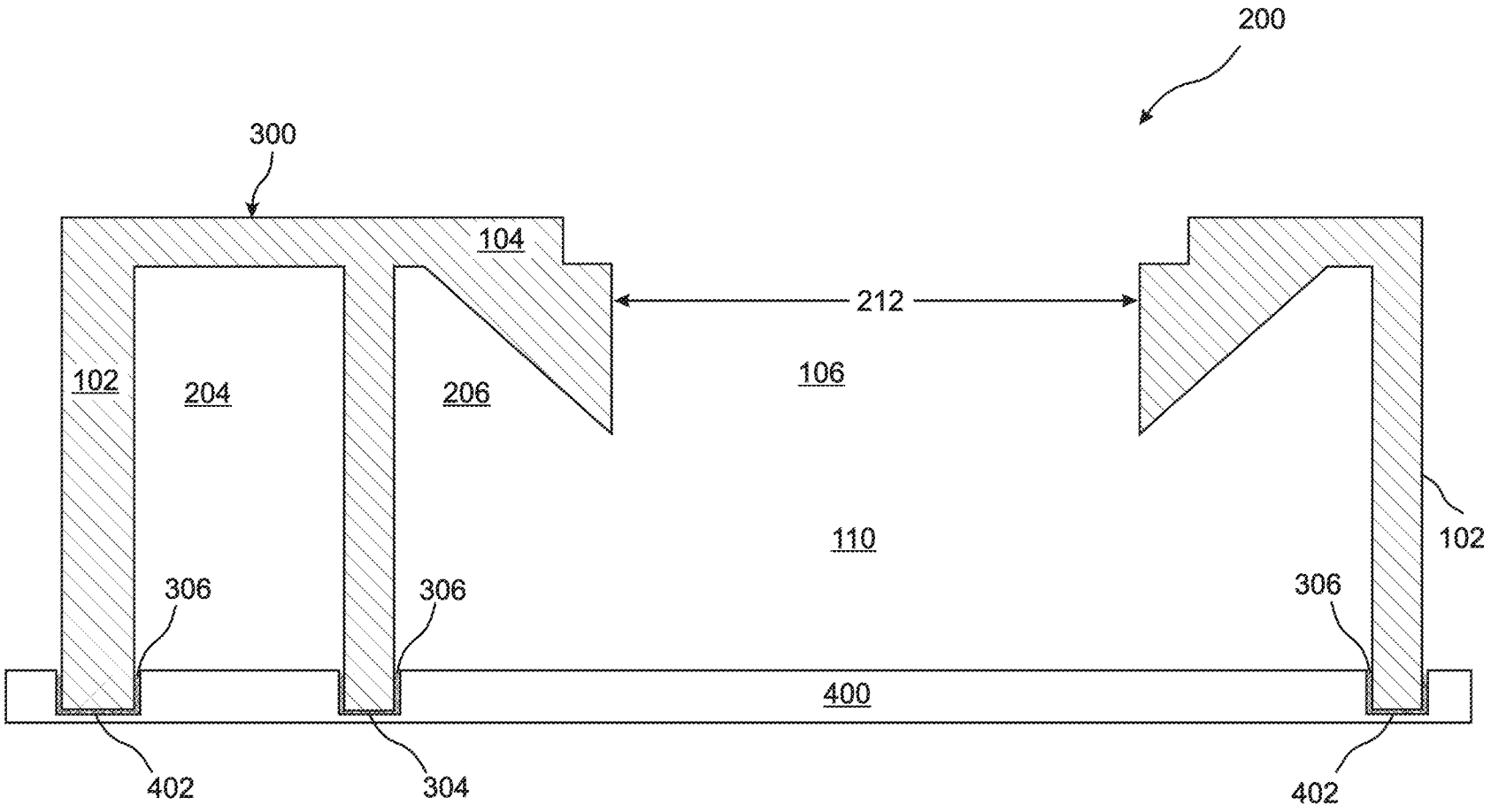
FIG. 4 is a cross-sectional view, drawn to scale, of a volute similar to FIG. 2A fixed to an underlying base.

FIG. 4 is a cross-sectional illustration that is similar to FIG. 3C, except that the sidewall 102 and the cutwater 202 of the volute 200 extend equally far downward from the top panel 104, similar to the embodiment of FIGS. 2A and 2B. In the illustrated embodiment, as in FIG. 3C, a recess 304 is provided in the base 400 that corresponds to the shape of the lower edge of the cutwater 202. Also, in the embodiment of FIG. 4, an additional recess 402 is provided in the base 400 that corresponds to the shape of the lower edge of the sidewall 102, so that the lower edge of the sidewall 102 and the lower edge of the cutwater 202 both extend into their respective recesses 304, 402, and are sealed therein by grout 306, such that the lower edge of the cutwater 202 and the lower edge of the sidewall 102 are both laterally supported and braced by the sides of their respective recesses 304, 400.

Figure 5:
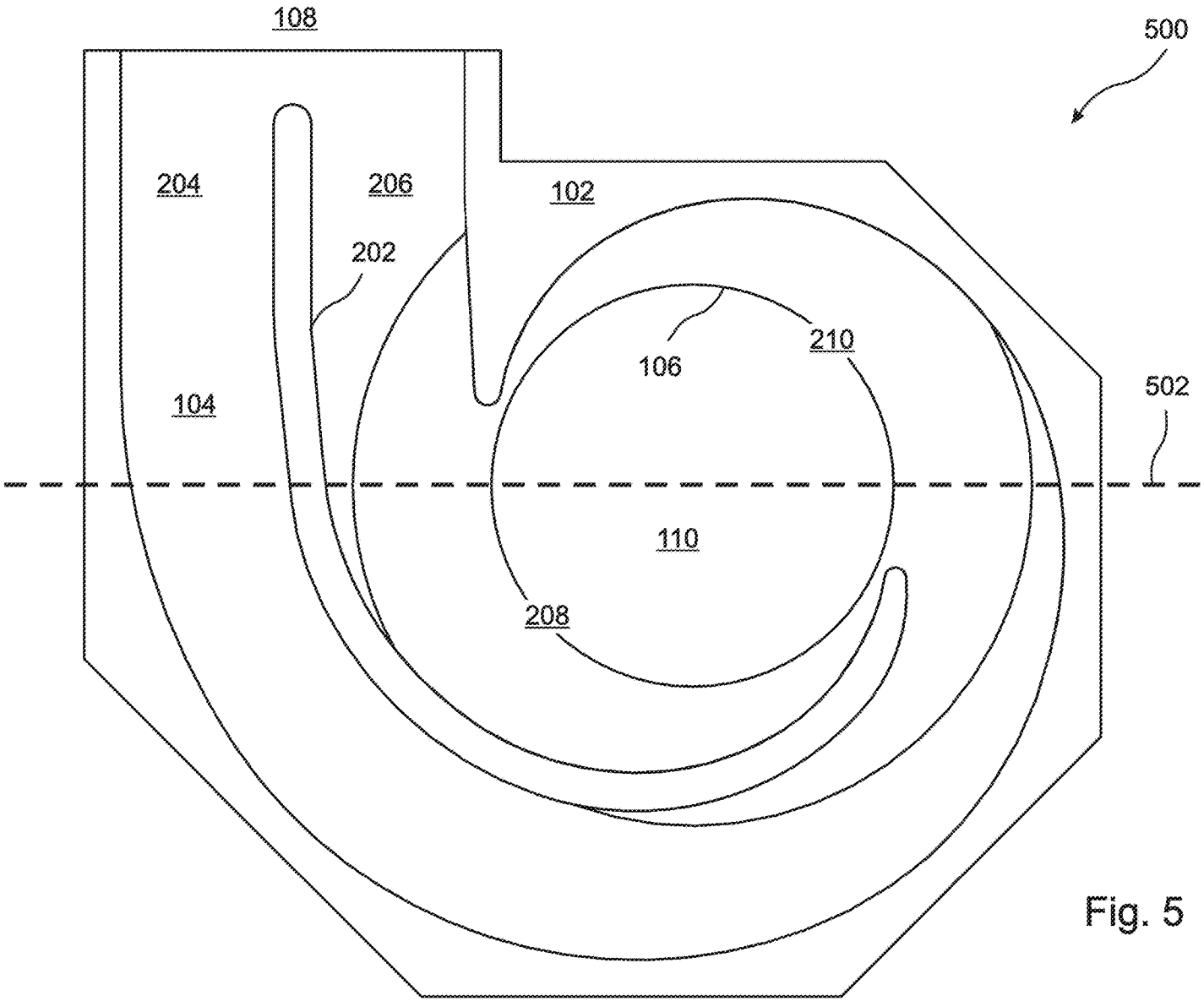
FIG. 5 is a bottom view drawn to scale of a volute in an embodiment of the present invention wherein the volute is precast in two sections.
Figure 6:
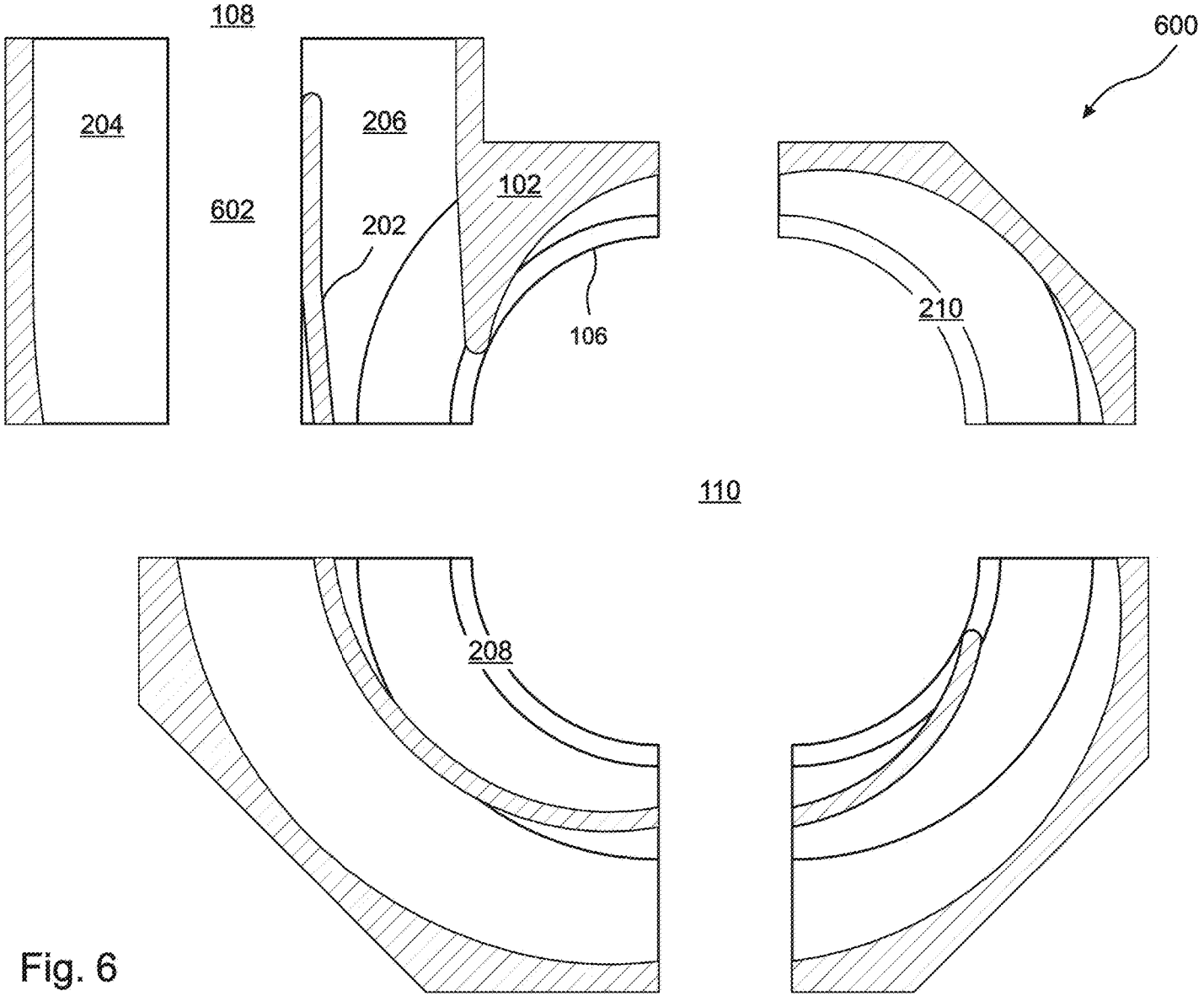
FIG. 6 is a bottom view drawn to scale of a volute in an embodiment of the present invention wherein the volute is precast in five sections.

As is discussed above, the additional support that is provided by the present invention to the lower edge of the cutwater 202, and in embodiments also to the sidewall 102, enables the volute to be precast in sections, transported to the application site, and then assembled and sealed to each other and to the base at the application site. FIG. 5 is a bottom view of a volute 500 in an embodiment where the volute 500 is precast in two sections, as indicated by the dividing line 502 provided in the figure. FIG. 6 is an exploded view from below of a volute 600 in an embodiment where the volute 600 is precast in five sections.

In both of FIGS. 5 and 6, the illustrated boundaries, or "cuts," between the sections have been selected such that, at the locations where the cuts intersect the cutwater 202 and side wall 102, the cuts are within 10 degrees of being perpendicular to the cutwater and side walls. As a result, the flow of the pumped liquid in the volute channels 204, 206 will be nearly parallel to the cutwater 202 and the sidewall 102 at each of the junctures between the sections, thereby minimizing any lateral forces that are applied to the cutwater 202 and sidewall 102 at the locations where the sections are joined together. It is notable that in FIG. 6, the cut 602 that is near the volute outlet 108 is nearly parallel to the cutwater 202, but has been offset such that it does not intersect the cutwater 202.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

Although the present application is shown in a limited number of forms, the scope of the disclosure is not limited to just these forms, but is amenable to various changes and modifications. The present application does not explicitly recite all possible combinations of features that fall within the scope of the disclosure. The features disclosed herein for the various embodiments can generally be interchanged and combined into any combinations that are not self-contradictory without departing from the scope of the disclosure. In particular, the limitations presented in dependent claims below can be combined with their corresponding independent claims in any number and in any order without departing from the scope of this disclosure, unless the dependent claims are logically incompatible with each other.

What is claimed is:

1. A method of providing a dual channel concrete CVP volute at an application site, the method comprising: pre-casting, at a location that is remote from the application site, a concrete volute upper portion comprising a top panel, a sidewall, and a cutwater, the sidewall and cutwater being joined at upper edges thereof to the top panel, the sidewall and cutwater extending downward from the top panel and forming, in combination, an impeller chamber and two volute channels extending from opposing sides of the impeller chamber to a volute outlet; locating, at the application site, a concrete volute base comprising a cutwater recess into which a lower edge of the cutwater extends when the volute upper portion is placed onto the volute base and sealed thereto, the cutwater recess comprising cutwater recess sides that provide lateral support and bracing to the lower edge of the cutwater; transporting the precast volute upper portion to the application site; placing the volute upper portion onto the volute base at the application site, such that the lower edge of the cutwater of the volute upper portion extends into the cutwater recess provided in the volute base; and sealing the volute upper portion to the volute base, the cutwater recess sides of the cutwater recess thereby providing lateral support and bracing to the lower edge of the cutwater, wherein locating the concrete volute base comprises casting a slab of concrete and forming the cutwater recess into the slab of concrete at the application site, thereby forming the concrete volute base.

2. The method of claim 1, wherein:

pre-casting the volute upper portion comprises pre-casting a plurality of volute upper portion sections;

transporting the precast volute upper portion to the application site comprises separately transporting each of the volute upper portion sections to the application site;

placing the volute upper portion onto the volute base at the application site comprises placing the volute upper portion sections onto the volute base and aligning and abutting together corresponding section boundaries of the volute upper portion sections with each other; and sealing the volute upper portion to the base comprises sealing the volute upper portion sections to the base and to each other.

3. The method of claim 2, wherein at each location where one of the section boundaries intersects the cutwater, the section boundary is within ten degrees of being perpendicular to the cutwater.

4. The method of claim 2, wherein at each location where one of the section boundaries intersects the sidewall, the section boundary is within ten degrees of being perpendicular to the sidewall.

5. The method of claim 1, wherein the volute base further comprises a sidewall recess having sidewall recess sides, and wherein the lower edge of the sidewall extends into the sidewall recess when the volute upper portion is placed onto the volute base, such that such that the sidewall recess sides provide lateral support and bracing to the lower edge of the sidewall.

6. The method of claim 1, wherein sealing the volute upper portion to the volute base comprises applying grout to seal the lower edge of the cutwater within the cutwater recess.

7. The method of claim 1, wherein the impeller chamber is sufficiently large to contain an impeller having a diameter of 1.2 meters.

8. The method of claim 1, wherein the impeller chamber is sufficiently large to contain an impeller having a diameter of 1.5 meters.

9. The method of claim 1, wherein forming the cutwater recess into the slab of concrete comprises at least one of: cutting into the concrete slab using a laser; cutting into the concrete slab using a focused stream of high-velocity sand; and placing a shaped cover on top of the concrete slab while it is being cast.

* * * * *